United States Patent [19]

Pask

[11] Patent Number: 4,472,108

[45] Date of Patent: Sep. 18, 1984

[54] SHROUD STRUCTURE FOR A GAS TURBINE ENGINE

[75] Inventor: George Pask, Stanton-by-Bridge, England

[73] Assignee: Rolls-Royce Limited, London, England

[21] Appl. No.: 395,988

[22] Filed: Jul. 7, 1982

[30] Foreign Application Priority Data

Jul. 11, 1981 [GB] United Kingdom ..... 8121447

[51] Int. Cl.[3] ..... F01D 11/00

[52] U.S. Cl. ..... 415/113; 415/127; 415/174

[58] Field of Search ..... 415/26, 113, 126–128, 415/116, 171, 174, 119

[56] References Cited

U.S. PATENT DOCUMENTS

| | | | |
|---|---|---|---|
| 3,085,398 | 4/1963 | Ingleson | 415/127 X |
| 4,213,735 | 7/1980 | Grennan | 415/26 X |
| 4,247,247 | 1/1981 | Thebert | 415/171 X |
| 4,251,185 | 2/1981 | Karstensen | 415/116 X |
| 4,317,646 | 3/1982 | Steel et al. | 415/116 |

FOREIGN PATENT DOCUMENTS

| | | |
|---|---|---|
| 1082634 | 9/1967 | United Kingdom . |
| 1497619 | 1/1978 | United Kingdom . |
| 2057722 | 4/1981 | United Kingdom . |

*Primary Examiner*—Robert E. Garrett
*Assistant Examiner*—Joseph M. Pitko
*Attorney, Agent, or Firm*—Cushman, Darby & Cushman

[57] ABSTRACT

A shroud assembly is pneumatically operated to adjust the clearance between the shroud segments and the tips of the rotor blades of an associated rotor. The assembly comprises a casing to which is secured a wall member which defines a chamber whose pressure may be varied by a valve. The wall member carries shroud segments some of which define the static wall with which the rotor blades co-operate. In order to allow proper movement of the shroud segments the support means which carry the segments from the wall are arranged to be small in axial extent compared with that of the wall.

12 Claims, 4 Drawing Figures

SHROUD STRUCTURE FOR A GAS TURBINE ENGINE

FIELD OF THE INVENTION

This invention relates to a shroud structure for a gas turbine engine and, more particularly, to a shroud structure in which the shroud segments are carried in spaced relationship to a deformable wall and moved radially relative to the casing. The deformable wall defines a chamber with respect to the casing and is movable toward and away from the casing by a pressure differential between pressure within the chamber and pressure on the inner surface of the deformable annular wall.

BACKGROUND OF THE INVENTION

In recent years it has been realised that the clearance between the tips of rotor blades and their associated static shrouds has a significant effect on the efficiency of operation of the stage of blades in question. Various attempts have therefore been made to maintain as small a clearance as possible in this situation. These attempts have largely involved modification of the static shroud to enable the internal diameter of the shroud to be varied to match the external diameter of the blade tips, either as previously calculated for the engine condition in question or as directly measured using a transducer of some kind.

The designs evolved to meet this problem have tended to fall into two main categories, in one of which shroud diameter variation has been effected by mechanical means and in the other of which this has been effected by thermal means. The mechanical devices, while swift in operation have tended to be heavy, and/or complicated and the thermal devices have tended to be simpler but slower to react.

BRIEF DESCRIPTION OF THE INVENTION

The present invention provides a shroud structure which is enabled to react quickly to the need for variation in diameter but which is also simple in construction.

According to the present invention a shroud structure for a gas turbine engine comprises a casing having an inner surface, an annular wall member spaced from said surface and sealed to it at its axial extremities to define a chamber therewith, the wall member being deformable towards or away from the casing in response to the pressure difference between said chamber and the radially inner surface of the wall member, means for varying the pressure in said chamber, a ring of shroud segments carried from the wall and defining a boundary of the flow path of the engine, and support means on the wall member which support the ring of segments, the support means being small in axial extent compared with the wall and extending from the mid section of the wall.

In a preferred embodiment the wall conforms in shape to the inner surface of the casing so that said chamber is small in volume.

The pressure in the chamber may be varied by alternatively supplying to it air which is at a pressure which approximates to that on the radially inner surface of the wall member or air at a lower pressure which will allow the wall member to be deformed towards the casing.

The support means may be arranged to allow some axial freedom of movement of the shroud segment, the segments being supported axially on an inboard sealing member.

BRIEF DESCRIPTION OF THE DRAWINGS

The invention will now be particularly described, merely by way of example, with reference to the accompanying drawings in which.

DETAILED DESCRIPTION OF THE INVENTION AND DRAWINGS

Figure 1:
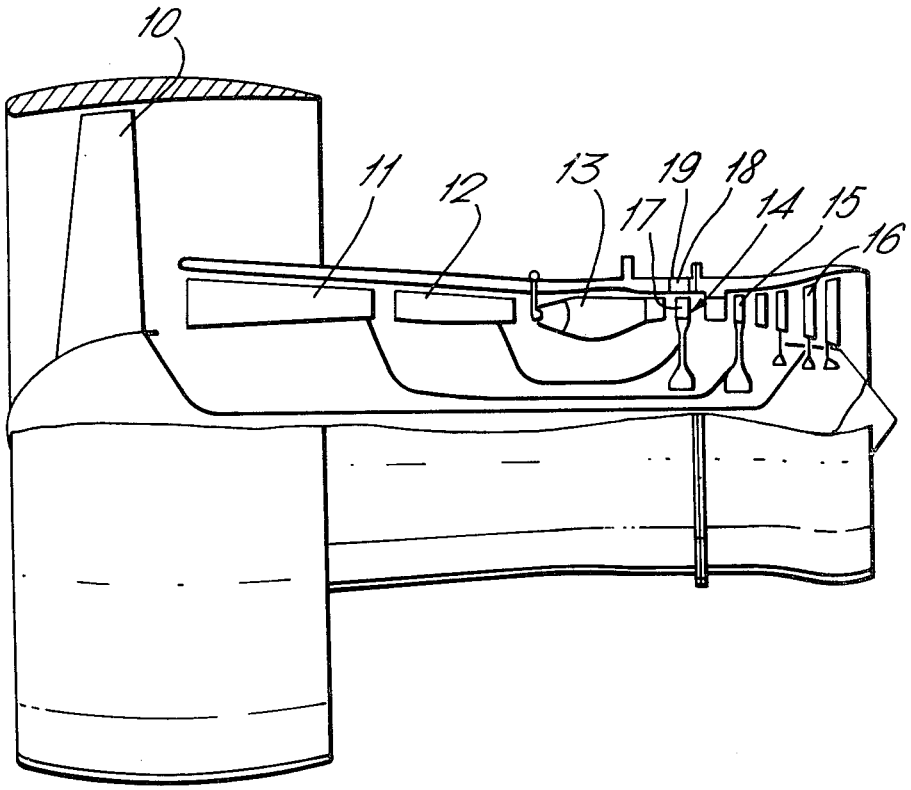
FIG. 1 is a partly broken-away view of a gas turbine engine having a shroud structure in accordance with the invention.

In FIG. 1 there is shown a gas turbine engine comprising a fan 10, intermediate and high pressure compressors 11 and 12, a combustion chamber 13, and high, intermediate and low pressure turbines 14, 15 and 16. Overall operation of the engine is conventional and well known in the art, and is not further described in this specification.

Figure 2:
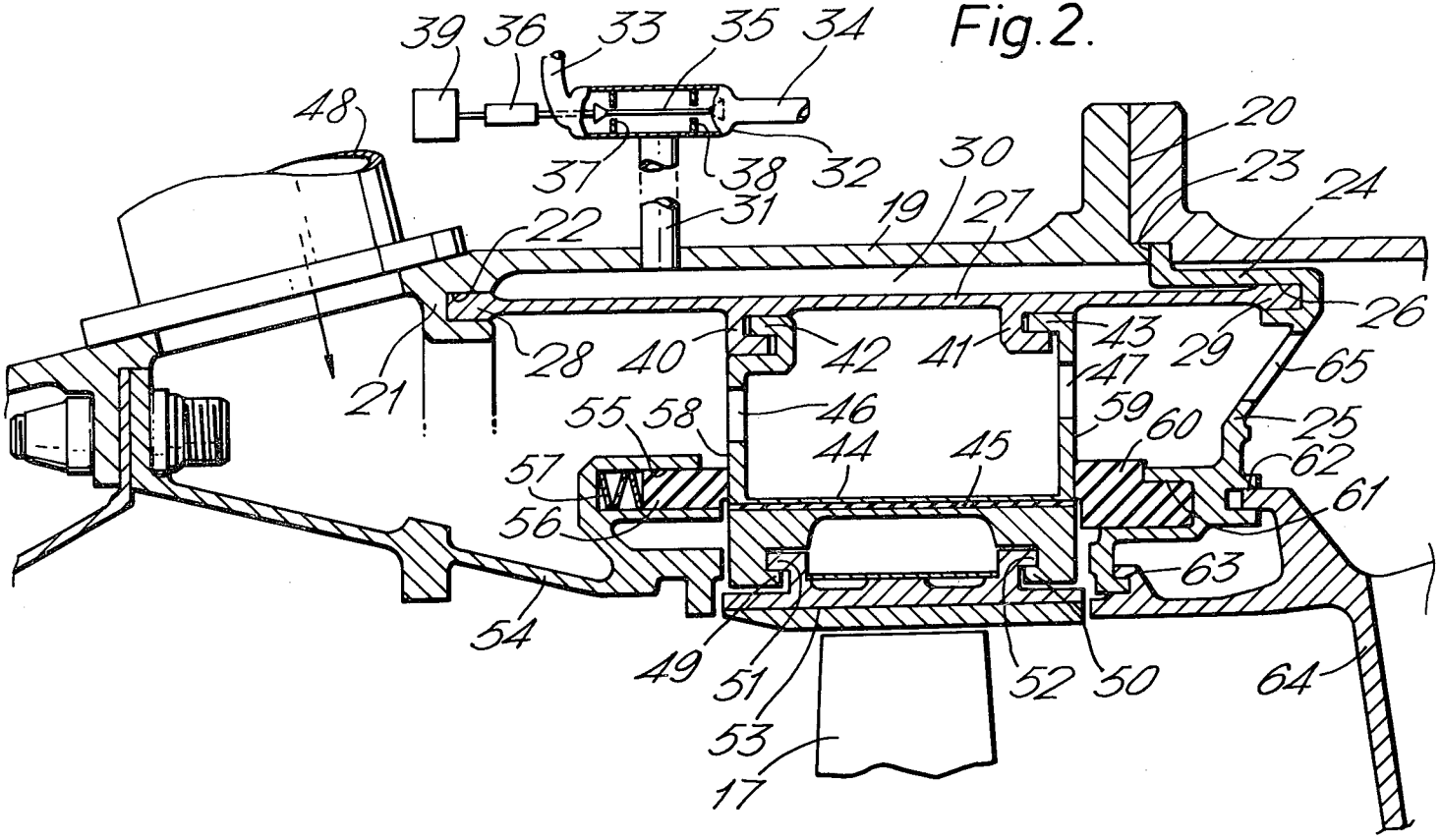
FIG. 2 is an enlarged section through the shroud structure of the engine of FIG. 1.

It has been found that the degree of clearance between the rotary and static components of the engine has a significant effect on the aerodynamic efficiency of the components involved. This is particularly true of the clearance between the tips of the rotor blades 17 of the high pressure turbine 14 and the associated static shroud structure at 18. The present invention relates to a structure by which this clearance may be maintained at a low value, and FIG. 2 shows the shroud structure 18 in accordance with the invention in enlarged cross-section.

The shroud structure is all supported, directly or indirectly, from the casing 19 of the engine. The casing 19 is basically cylindrical, and in the present instance is formed in two abutting sections joined at a flanged joint 20, although this joint is not relevant to the structure of the present invention. The inner surface of the casing 19 is substantially cylindrical and has a forward mounting member 21 affording a rearwardly facing annular slot 22, and a rearward mounting groove 23. The groove 23 retains an annular mounting flange 24 at the outer extremity of a generally frusto-conical support member 25, and in the flange is defined a forwardly-facing annular slot 26.

Between the slots 22 and 26 is located and mounted a relatively thin annular wall member 27. The wall member 27 has thickened edges 28 and 29 at its foward and rearward peripheries respectively which sealingly engage within the slots 22 and 26 so that the wall member 27 and casing 19 between them define a sealed chamber 30. In order to allow the wall member 27 to deflect in response to internal pressures within the chamber 30 it is made of a low modulus material, in this case titanium.

The chamber 30 is provided with a supply of pressure fluid via a duct 31 and a changeover valve 32 which allows the duct 31 to be connected via a first supply pipe 33 with a supply of relatively high pressure fluid or via a second supply pipe 34 with a supply of relatively low pressure fluid. In the present case the high pressure fluid is bled from the high pressure compressor 12, while the low pressure fluid is bled from the fan duct of the engine. The valve 32 has a valve member 35 driven by a ram 36 to close or open to a greater or lesser degree the valve orifices 37 and 38. The ram is controlled by a control unit 39. The supply of air through the duct 31 can therefore be arranged to be at the high pressure, or at the low pressure, or at an intermediate pressure. Therefore, by using the valve 32 the pressure within the chamber 30 may be varied, and assuming that the pressure on the radially inner surface of the wall member 27 remains constant this will cause movement of the wall member 27 towards or away from the casing 19.

The wall member 27 is itself provided with mounting means in the form of annular arrays of L-section flanges 40 and 41 defining rearwardly facing grooves. Within the grooves are retained the forward projections 42 and 43 from the radially projecting limbs of a generally U-section supporting segment 44. These are a plurality of the part-annular supporting segments 44 which together make up a fully-annular array, and each segment is supported on two of the flanges 40 and two of the flanges 41.

In order to reduce gas leakage between the abutting ends of the segments 44, the ends are provided at 45 with facing grooves and sealing inserts such, for instance, as are disclosed in our British patent 1081458. It will also be seen that the limbs of the U-section of the segments are apertured at 46 and 47 to allow the free flow therethrough of cooling/sealing air which enters the area through ducts 48 which pass air through the casing 19. Further details of this cooling and sealing arrangement are described below.

The support segments 44 are provided, on their radially inner surfaces, with L-section flanges 49 and 50 similar to the flanges 40 and 41. In this case, however, the grooves formed between the flanges and the main inner surface of the segments face towards one another, and in these engage corresponding projections 51 and 52 from part-annular intermediate segments 53. The segments 53 again abut to form a complete annulus, and their radially inner faces serve to define the outer boundary of the gas flow immediately outside the turbine rotor blades 17. It will be seen that the inner faces of the segments define a small clearance with the tips of the rotor blades 17, and it has been found that the size of this clearance can have a significant effect on the efficiency of the turbine. By varying the pressure in the chamber 30 using the valve 32, the position of the wall 27 can be altered and thus the radial position of the various segments and the size of this clearance varied as described below.

It must clearly be arranged that the hot gas flow of the engine does not flow round the various segments, and sealing means must therefore be provided which seal against the segments and yet which allow them to move radially as mentioned above. In order to do this, a substantially frusto-conical casing 54 extends from the casing 19 just beyond the ducts 48, and has formed in its free extremity an annular groove 55. Within the groove 55 sits an annular face seal 56 which preferably comprises a graphite material, the seal 56 being resiliently loaded by annular springs 57 against the flat face 58 formed on the upstream face of the supporting segments 44. This effectively seals the upstream side of the array of segments.

The downstream faces 59 of the segments 44 abut against a further graphite sealing ring 60 which is held rigidly in an annular groove 61 in the support structure 25. The structure 25 as mentioned above is again generally frusto-conical and forms at its outer extremity the flange 24 which is supported in the groove 23. Adjacent the seal ring 60 the structure 25 sealingly engages at 62 and 63 with the platform structure of the stage of nozzle guide vanes 64 immediately downstream of the rotor blades 17. This sealing engagement completes the sealing of the chamber round the segments, since the frusto-conical support structure extending from the groove 61 to the flange 24 is apertured at 65 to allow flow of air therethrough.

It will be seen that not only does the ring 60 provide sealing of the shroud assembly, but it is also arranged to restrain the assembly against axial loads. Because of the pressure drop across the stage of rotor blades 17 there is a pressure differential across the parts of the segments inboard of the seals 56 and 60 acting to push the structure downstream. The connections at 40 and 41 are specifically designed not to restrain the segments 44 in this direction, so that no twisting loads are put on the wall member 27. The total axial load on the shroud segment assembly is therefore taken by the faces 59 bearing on the ring 60 which itself bears on the structure 25 and thus on the flange 23 and casing 19.

Overall operation of the structure is therefore that in accordance with the value of the clearance, either deduced from engine parameters or measured directly using a transducer (not shown), the control of the measuring unit 39 causes the valve 32 to operate to allow higher or lower pressure air into the chamber 30. In the present instance the higher pressure air from the pipe 33 is the same as that flowing through the ducts 48, and in consequence when the valve 32 is in one position the pressure is equal on both sides of the wall 27. The wall in this condition maintains its normal, unstresses shape.

When the valve 32 is fully changed over to its alternative position, the relatively high pressure air in the chamber 30 flows out through the pipe 34 and the pressure in the chamber 30 drops to a relatively low value. The higher pressure air acting on the inner surface of the wall 27 causes it to move towards the inner surface of the casing 19, moving the wall 27 radially outwardly and thus carrying the segments 44 and 53 outwards and increasing the clearance between the shroud segments and the tips of the blades 17. Between these extremes there are intermediate positions.

Therefore, by measuring or deducing this clearance the valve 32 can be operated to move the segments to maintain a small value of the clearance. It will be seen that by arranging that the support for the segments 44 is relatively small in axial dimension compared with the axial length of the wall 27, the movement of the segments can be kept linear and parallel to the unrestrained mid-section of the wall. Again, the relatively large axial extent of the wall 27 allows the necessary movement of the segments to be achieved without overstraining the wall.

It will also be noted that the connection between the segment assembly and the wall 27 is such as to divorce the wall from any likely bending loads, again allowing the wall to be thin and able to be deflected under the influence of pressure. The sealing ring 60 takes the axial load on the segment assembly, and in conjunction with the ring 56 and the other sealing means at 45 enables the support segments 44 and the wall member 27 to be washed with relatively cool air to maintain their temperature. If required it is possible to cool the segments 53 themselves by e.g. impingement cooling.

Figure 3:
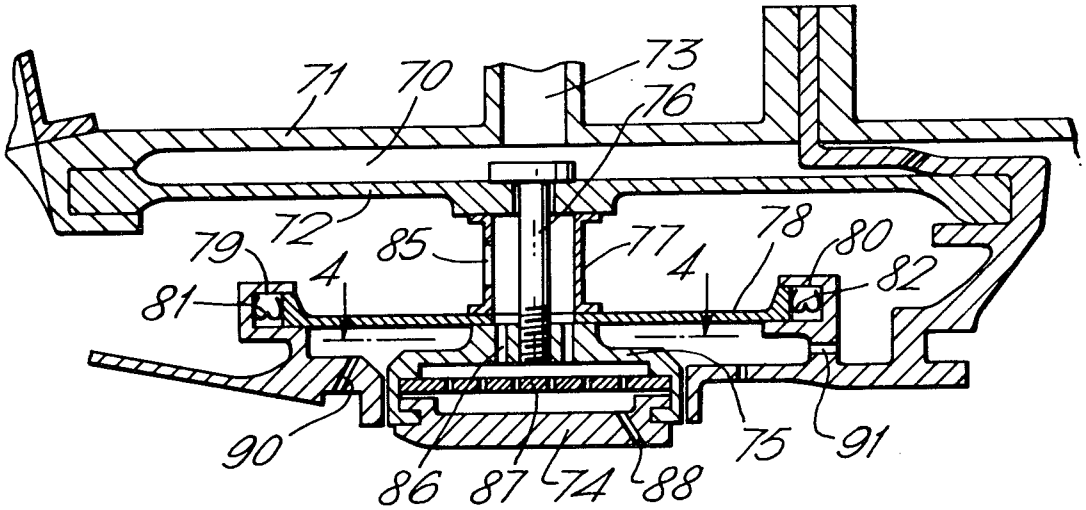
FIG. 3 is a view similar to FIG. 2 but of a second embodiment.
Figure 4:
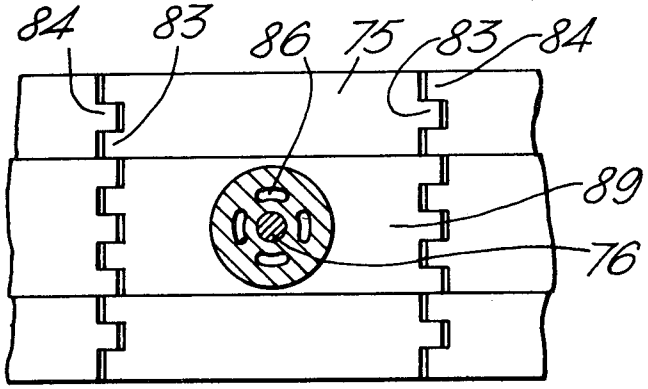
FIG. 4 is a section on the line 4—4 of FIG. 3.

This is in fact illustrated in the second embodiment of FIGS. 3 and 4. Here the basic structure is the same as in the previous embodiment in that the space 70 between a casing 71 and wall member 72 may be pressurised via an inlet duct 73 to provide predetermined deflection of the wall member 72. However, the way in which the shroud segments 74 are supported from the member 72 differs.

In this instance the wall member 72 carries supporting segments 74 via bolts 76 and tubular members 77. The bolts 76 pull the segments 75 into engagement with the tubular members 77 via an auxiliary cylindrical wall member 78. The wall member 78 engages with annular groove 79 and 80 in the fixed structure of the engine and is sealed thereto by sealing rings 81 and 82. The auxilliary wall member 78 serves the dual purpose of providing a sealed chamber to prevent hot gases flowing unrestrictedly between the casings of the engine and provides some additional support of the segments in the axial direction.

Each of the supporting segments 75 and shroud segments 74 is provided with castellated ends 83 which interdigitate with the correspondingly castellated ends 84 of the next adjacent segments to provide location of the segments. In order to cool the segments 74, apertures 85 are provided in the tubes 77 to allow cooling air to flow through holes 86 in the supporting segments 75. This air then flows through holes in impingement plates 87 to impinge upon the outer surface of the shroud segments 74 to cool them. The spent cooling air then flows via holes 88 to rejoin the gas stream of the engine.

It will be seen that a central rib 89 divides each support segment 75 into forward and rearward sections, and thus divides the space inboard of the auxiliary wall 77 in a similar manner. Each of the chambers thus formed is vented, the forward chamber via apertures 90 to a high pressure and the rearward chamber via apertures 91 to a lower pressure.

It will be understood that there are a number of ways in which the embodiments described could be modified and yet still be in accordance with the invention. Thus either or both of the casing 19, 17 and wall member 27, 72 could be of different shape to the substantially cylindrical shape shown; they could for instance be frustoconical. The mounting for the support segments could be made as a double, axially-spaced engagement if the engine conditions were such as to require this.

It will also be understood that although in the illustrated embodiment the pressure balance across the wall member 27 or 72 is arranged either to keep it undeformed or to force it outwards; this could be changed. Thus the wall 27 or 72 could be normally abutting the casing 19 or 71 and forced inwards, by high pressure air in the space 30 or 70.

I claim:

1. A shroud assembly for a gas turbine engine comprising:

an annular casing having an inner surface;

a deformable annular wall member coaxial of said casing and having an inner surface and an outer surface, said outer surface of said annular wall being spaced radially inwardly from said inner surface of said annular casing, said annular wall member having axial extremities sealed to said casing to define a chamber between said inner surface of said casing and said outer surface of said annular wall, said annular wall being deformable towards and away from said casing in response to a pressure differential between said chamber and said inner surface of said annular wall member;

means for varying fluid pressure within said chamber;

a ring of circumferentially arranged shroud segments coaxially of and radially spaced from said inner surface of said annular wall member, said ring of circumferentially arranged shroud segments defining a boundary flow path of the engine;

support means on said annular wall member for supporting said ring of circumferentially arranged shroud segments, said support means having upstream and downstream ends and further having a small axial extent therebetween when compared with an axial extent of said annular wall member, said support means extending from a section axially in the middle of said annular wall member, and said support means being arranged to allow axial movement of said ring of circumferentially arranged segments relative to said annular wall;

and sealing means between said fixed casing and said upstream and downstream ends of said support means.

2. A shroud assembly as claimed in claim 1 and in which said wall member conforms in shape to said inner surface of said casing so that said chamber is small in volume.

3. A shroud assemby as claimed in claim 1 or claim 2 in which said means for varying fluid pressure within said chamber includes valve means adapted to allow the pressure within said chamber either to approximate to that on the radially inner surface of the wall or to be at a different pressure, where the wall will be deformed towards or away from the casing.

4. A shroud assembly as claimed in claim 1 and in which said support means comprises at least one flange providing an axially facing groove in which an axially extending projection from the segments extends.

5. A shroud assembly as claimed in claim 4 in which said support means comprises two flanges axially spaced apart and which provide upstream and downstream axially facing grooves in which axially extending projections from said shroud segments extend.

6. A shroud assembly as claimed in claim 1 and in which said support means includes an auxiliary deformable wall member sealed to adjacent static structure and adapted to prevent hot engine gases escaping into the engine casing area.

7. A shroud assembly as claimed in claim 6 and comprising apertures in said auxiliary deformable wall member adapted to allow cooling air to flow to said segments from outside said auxiliary wall member.

8. A shroud assembly as claimed in claim 7 and including means for impingement cooling of said segments.

9. A shroud assembly as claimed in claim 1 in which said sealing means includes a rigidly located sealing ring between said fixed structure and one of said upstream and downstream ends of said support means, said rigidly located sealing ring supporting said support means against axial movement.

10. A shroud assembly as claimed in claim 9 in which said sealing means includes a second sealing ring which resiliently seals the other of said upstream and downstream ends of said support means against said fixed casing.

11. A shroud assembly as claimed in claim 1 including further sealing means between each pair of circumferentially arranged shroud segments.

12. A shroud assembly as claimed in claim 11 and in which there are a plurality of nested rings of said segments.

* * * * *